US011142365B2

(12) United States Patent
Kearns et al.

(10) Patent No.: US 11,142,365 B2
(45) Date of Patent: Oct. 12, 2021

(54) CARTON FOR AN ARTICLE

(71) Applicant: Graphic Packaging International, LLC, Atlanta, GA (US)

(72) Inventors: Matthew R. Kearns, Woodstock, GA (US); Steven M. Oliveira, Canton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 16/845,216

(22) Filed: Apr. 10, 2020

(65) Prior Publication Data

US 2020/0339302 A1 Oct. 29, 2020

Related U.S. Application Data

(63) Continuation of application No. 29/689,508, filed on Apr. 30, 2019, now Pat. No. Des. 898,565.

(Continued)

(51) Int. Cl.

*B65D 5/02* (2006.01)
*B31B 50/28* (2017.01)

(Continued)

(52) U.S. Cl.

CPC ..... *B65D 5/0209* (2013.01); *B31B 50/28* (2017.08); *B65D 5/4266* (2013.01); *B65D 5/542* (2013.01);

(Continued)

(58) Field of Classification Search

CPC .... B65D 5/0209; B65D 5/4266; B65D 5/542; B65D 3/06; B65D 1/265; B65D 3/04; B65D 3/08; B31B 50/28; B31B 2110/20

(Continued)

(56) References Cited

U.S. PATENT DOCUMENTS 926,758 A 7/1909 Miller
1,253,193 A 1/1918 Hill (Continued)

FOREIGN PATENT DOCUMENTS

BE 671 762 3/1966
CA 27146 4/1965

(Continued)

OTHER PUBLICATIONS

International Search Report and Written Opinion for PCT/US2020/027580 dated Jul. 27, 2020.

(Continued)

*Primary Examiner* — Christopher R Demeree
(74) *Attorney, Agent, or Firm* — Womble Bond Dickinson (US) LLP

(57) ABSTRACT

A carton for holding at least one article includes a plurality of panels extending at least partially around an interior of the carton, the plurality of panels comprising a front panel, a back panel, and at least one side panel, at least one top end flap foldably connected to a panel of the plurality of panels, and at least one bottom end flap foldably connected to a panel of the plurality of panels. The at least one bottom end flap is for forming a closed bottom of the carton and the at least one top end flap is for forming a closed top of the carton. The closed top of the carton has a square configuration and the closed bottom has a round configuration.

33 Claims, 10 Drawing Sheets

Related U.S. Application Data

(60) Provisional application No. 62/837,337, filed on Apr. 23, 2019.

(51) Int. Cl.

| | |
|---|---|
| ***B65D 5/42*** | (2006.01) |
| ***B65D 5/54*** | (2006.01) |
| ***B31B 50/20*** | (2017.01) |
| ***B31B 120/30*** | (2017.01) |
| ***B31B 120/40*** | (2017.01) |
| ***B31B 110/10*** | (2017.01) |

(52) U.S. Cl.
CPC ..... *B31B 50/20* (2017.08); *B31B 2110/10* (2017.08); *B31B 2120/302* (2017.08); *B31B 2120/40* (2017.08)

(58) Field of Classification Search
USPC ..... 229/107, 106, 400, 404, 405, 4.5
See application file for complete search history.

(56) References Cited

U.S. PATENT DOCUMENTS

| | | | |
|---|---|---|---|
| 2,115,673 | A | 4/1938 | Stompe |
| 2,382,368 | A | 8/1945 | Mitchell, Jr. |
| 2,383,183 | A | 8/1945 | Fishcher |
| 2,586,301 | A | 2/1952 | Castle |
| 2,594,376 | A | 4/1952 | Arneson |
| 2,702,144 | A | 2/1955 | Forrer |
| 2,797,856 | A | 7/1957 | Jaeschke |
| 2,800,224 | A | 7/1957 | Walter et al. |
| 2,810,506 | A | 10/1957 | Kessler |
| 2,819,506 | A | 10/1957 | Kessler |
| 2,849,111 | A | 8/1958 | Fielding |
| 2,868,433 | A | 1/1959 | Anderson, Jr. |
| 2,922,561 | A | 1/1960 | Currivan |
| 2,928,541 | A | 3/1960 | Fielding |
| 2,955,739 | A | 10/1960 | Collura |
| 3,112,856 | A | 12/1963 | MacIntosh et al. |
| 3,127,720 | A | 4/1964 | Gentry et al. |
| 3,166,235 | A | 1/1965 | Schroeder |
| 3,178,242 | A | 4/1965 | Ellis et al. |
| 3,204,814 | A | 9/1965 | Mahon |
| 3,204,815 | A | 9/1965 | Weis |
| 3,300,115 | A | 1/1967 | Schauer |
| 3,306,519 | A | 2/1967 | Wood |
| 3,309,005 | A | 3/1967 | Pilger |
| 3,334,767 | A | 8/1967 | Cornelius et al. |
| 3,339,723 | A | 9/1967 | Wood |
| 3,355,012 | A | 11/1967 | Weiss |
| 3,356,279 | A | 12/1967 | Root |
| 3,373,867 | A | 3/1968 | Wood |
| 3,381,881 | A | 5/1968 | Granz et al. |
| 3,402,876 | A | 9/1968 | Kuchenbecker |
| 3,593,849 | A | 7/1971 | Helms |
| 3,633,814 | A | 1/1972 | Michetti |
| 3,635,452 | A | 1/1972 | Helms |
| 3,638,851 | A | 2/1972 | Offer et al. |
| 3,669,342 | A | 6/1972 | Funkhouser |
| 3,747,835 | A | 7/1973 | Graser |
| 3,767,042 | A | 10/1973 | Ganz |
| D230,955 | S | 3/1974 | Katzenmeyer |
| 3,807,624 | A | 4/1974 | Funkhouser |
| 3,828,926 | A | 8/1974 | Rossi |
| 3,886,901 | A | 6/1975 | Zeitter |
| 3,894,681 | A | 7/1975 | Arneson et al. |
| 3,904,036 | A | 9/1975 | Forrer |
| 3,912,156 | A | 10/1975 | May |
| 3,917,157 | A | 11/1975 | Smith |
| 3,933,303 | A | 1/1976 | Kirby, Jr. |
| 3,963,121 | A | 6/1976 | Kipp |
| 3,994,432 | A | 11/1976 | Kirby, Jr. |
| 4,010,593 | A | 3/1977 | Graham |
| 4,017,017 | A | 4/1977 | Vos |
| 4,022,372 | A | 5/1977 | Graser |
| 4,029,204 | A | 6/1977 | Manizza |
| D244,993 | S | 7/1977 | Drysdale |
| 4,036,423 | A | 7/1977 | Gordon |
| 4,063,679 | A | 12/1977 | Henry |
| 4,094,457 | A | 6/1978 | Spillson |
| 4,096,985 | A | 6/1978 | Wood |
| 4,101,069 | A | 7/1978 | Wood |
| 4,111,306 | A | 9/1978 | Roccaforte |
| D250,748 | S | 1/1979 | Leger |
| 4,173,823 | A | 11/1979 | Anderson et al. |
| 4,202,446 | A | 5/1980 | Sutherland |
| 4,216,861 | A | 8/1980 | Oliff |
| 4,260,097 | A | 4/1981 | Nold |
| 4,318,474 | A | 3/1982 | Hasegawa |
| 4,328,893 | A | 5/1982 | Oliff et al. |
| 4,328,923 | A | 5/1982 | Graser |
| 4,329,923 | A | 5/1982 | Lida |
| 4,331,289 | A | 5/1982 | Killy |
| 4,360,107 | A | 11/1982 | Roccaforte |
| 4,364,509 | A | 12/1982 | Holley et al. |
| 4,375,258 | A | 3/1983 | Crayne et al. |
| 4,378,905 | A | 4/1983 | Roccaforte |
| 4,382,505 | A | 5/1983 | Sutherland et al. |
| 4,394,903 | A | 7/1983 | Bakx |
| 4,396,143 | A | 8/1983 | Killy |
| 4,417,655 | A | 11/1983 | Forbes, Jr. |
| 4,418,864 | A | 12/1983 | Nielsen |
| 4,420,111 | A | 12/1983 | Hament |
| 4,424,901 | A | 1/1984 | Lanier |
| 4,436,244 | A | 3/1984 | Morris |
| 4,440,340 | A | 4/1984 | Bakx |
| 4,470,503 | A | 9/1984 | Stone |
| 4,476,989 | A | 10/1984 | Larsen |
| 4,478,334 | A | 10/1984 | Graser |
| 4,498,619 | A | 2/1985 | Roccaforte |
| 4,508,258 | A | 4/1985 | Graser |
| 4,538,759 | A | 9/1985 | Dutcher |
| 4,545,485 | A | 10/1985 | Oliff |
| 4,546,914 | A | 10/1985 | Roccaforte |
| 4,564,139 | A | 1/1986 | Reil |
| 4,566,593 | A | 1/1986 | Muller |
| 4,567,341 | A | 1/1986 | Brown |
| 4,577,762 | A | 3/1986 | Kuchenbecker |
| 4,577,799 | A | 3/1986 | Oliff |
| 4,588,084 | A | 5/1986 | Holley, Jr. |
| 4,653,686 | A | 3/1987 | Wood et al. |
| 4,691,858 | A | 9/1987 | Peer, Jr. |
| 4,706,876 | A | 11/1987 | Wilson |
| 4,730,766 | A | 3/1988 | Fear |
| 4,747,487 | A | 5/1988 | Wood |
| 4,747,534 | A | 5/1988 | Marie |
| 4,765,534 | A | 8/1988 | Zion et al. |
| 4,784,266 | A | 11/1988 | Chaussadas |
| 4,784,316 | A | 11/1988 | Crouch |
| 4,802,583 | A | 2/1989 | Calvert et al. |
| 4,804,089 | A | 2/1989 | Wilson |
| 4,830,267 | A | 5/1989 | Wilson |
| 4,875,585 | A | 10/1989 | Kadleck et al. |
| 4,875,586 | A | 10/1989 | Chaussadas |
| 4,890,440 | A | 1/1990 | Romagnoli |
| 4,901,849 | A | 2/1990 | Wilson |
| D306,402 | S | 3/1990 | Colla |
| 4,910,913 | A | 3/1990 | Streeter |
| 4,919,266 | A | 4/1990 | McIntosh et al. |
| 4,949,845 | A | 8/1990 | Dixon |
| D311,339 | S | 10/1990 | Weed |
| 4,966,324 | A | 10/1990 | Steel |
| 4,972,991 | A | 11/1990 | Schuster |
| 4,974,771 | A | 12/1990 | Lavery |
| 5,000,313 | A | 3/1991 | Cliff |
| 5,020,337 | A | 6/1991 | Krieg |
| D318,235 | S | 7/1991 | Weed |
| 5,042,660 | A | 8/1991 | Carver |
| 5,060,792 | A | 10/1991 | Cliff |
| 5,071,062 | A | 12/1991 | Bradley et al. |
| 5,072,876 | A | 12/1991 | Wilson |
| 5,094,359 | A | 3/1992 | DeMars et al. |
| 5,098,014 | A | 3/1992 | Perkins |

(56) References Cited

U.S. PATENT DOCUMENTS

| | | | |
|---|---|---|---|
| 5,106,014 | A | 4/1992 | Miller |
| 5,118,032 | A | 6/1992 | Geho |
| 5,119,985 | A | 6/1992 | Dawson et al. |
| 5,131,588 | A | 7/1992 | Cliff |
| 5,137,211 | A | 8/1992 | Summer et al. |
| 5,180,100 | A | 1/1993 | Shimizu |
| 5,195,676 | A | 3/1993 | LeBras |
| 5,197,598 | A | 3/1993 | Stout et al. |
| 5,221,041 | A | 6/1993 | Stout et al. |
| 5,222,658 | A | 6/1993 | DeMaio et al. |
| 5,234,102 | A | 8/1993 | Schuster et al. |
| 5,246,112 | A | 9/1993 | Stout et al. |
| 5,263,634 | A | 11/1993 | Korine |
| 5,284,294 | A | 2/1994 | Floyd |
| 5,292,058 | A | 3/1994 | Zoss et al. |
| 5,297,673 | A | 3/1994 | Sutherland |
| 5,297,725 | A | 3/1994 | Sutherland |
| 5,303,863 | A | 4/1994 | Arasim |
| 5,307,932 | A | 5/1994 | Stout et al. |
| 5,307,986 | A | 5/1994 | Schuster |
| 5,320,277 | A | 6/1994 | Stout et al. |
| 5,328,030 | A | 7/1994 | Sutherland |
| 5,328,081 | A | 7/1994 | Saulas |
| 5,333,734 | A | 8/1994 | Stout et al. |
| D350,480 | S | 9/1994 | Sutherland |
| 5,350,110 | A | 9/1994 | Will |
| 5,351,878 | A | 10/1994 | Cooper |
| 5,358,175 | A | 10/1994 | Cai |
| 5,379,944 | A | 1/1995 | Stout et al. |
| 5,381,891 | A | 1/1995 | Harris |
| 5,385,234 | A | 1/1995 | Stout et al. |
| 5,395,044 | A | 3/1995 | Stout |
| 5,421,458 | A | 6/1995 | Campbell |
| 5,427,241 | A | 6/1995 | Sutherland |
| 5,458,234 | A | 10/1995 | Harris |
| D364,344 | S | 11/1995 | Shaw |
| 5,472,090 | A | 12/1995 | Sutherland |
| 5,472,136 | A | 12/1995 | Roccaforte |
| 5,472,138 | A | 12/1995 | Ingram |
| 5,485,915 | A | 1/1996 | Harris |
| D367,816 | S | 3/1996 | Cai |
| 5,495,727 | A | 3/1996 | Strong et al. |
| 5,505,372 | A | 4/1996 | Edson et al. |
| 5,524,756 | A | 6/1996 | Sutherland |
| 5,535,940 | A | 7/1996 | Olds |
| 5,542,536 | A | 8/1996 | Sutherland |
| 5,551,556 | A | 9/1996 | Sutherland |
| 5,558,212 | A | 9/1996 | Sutherland |
| 5,558,213 | A | 9/1996 | Sutherland |
| 5,560,539 | A | 10/1996 | Baxter |
| 5,582,343 | A | 12/1996 | Dalvey |
| 5,597,071 | A | 1/1997 | Sutherland |
| D377,861 | S | 2/1997 | Jacober |
| 5,605,279 | A | 2/1997 | Adamek |
| 5,609,251 | A | 3/1997 | Harris |
| 5,622,309 | A | 4/1997 | Matsuda et al. |
| 5,639,017 | A | 6/1997 | Fogle |
| 5,647,483 | A | 7/1997 | Harris |
| 5,664,401 | A | 9/1997 | Portrait et al. |
| 5,664,683 | A | 9/1997 | Brody |
| 5,669,500 | A | 9/1997 | Sutherland |
| 5,678,492 | A | 10/1997 | Pinkstone et al. |
| 5,682,995 | A | 11/1997 | Sutherland |
| 5,690,213 | A | 11/1997 | Matsumura |
| 5,692,614 | A | 12/1997 | Harris |
| 5,699,957 | A | 12/1997 | Bin et al. |
| 5,704,470 | A | 1/1998 | Sutherland |
| 5,738,273 | A | 4/1998 | Auclair |
| 5,739,273 | A | 4/1998 | Engelman et al. |
| 5,778,630 | A | 7/1998 | Portrait et al. |
| 5,794,778 | A | 8/1998 | Harris |
| 5,794,811 | A | 8/1998 | Walsh |
| 5,806,755 | A | 9/1998 | Correll |
| 5,826,782 | A | 10/1998 | Stout |
| 5,826,783 | A | 10/1998 | Stout |
| 5,833,130 | A | 11/1998 | Correll |
| 5,848,749 | A | 12/1998 | Ljungstrom |
| 5,853,088 | A | 12/1998 | Saulas et al. |
| 5,855,318 | A | 1/1999 | Baxter |
| 5,860,587 | A | 1/1999 | Young |
| 5,873,515 | A | 2/1999 | Dunn et al. |
| 5,875,961 | A | 3/1999 | Stone et al. |
| 5,878,946 | A | 3/1999 | Frerot et al. |
| 5,906,313 | A | 5/1999 | Cliff |
| 5,915,546 | A | 6/1999 | Harrelson |
| 5,921,398 | A | 7/1999 | Carroll |
| 5,924,559 | A | 7/1999 | Carrel et al. |
| 5,931,300 | A | 8/1999 | Sutherland |
| 5,937,620 | A | 8/1999 | Chalendar |
| 5,941,453 | A | 8/1999 | Cliff |
| 5,943,847 | A | 8/1999 | Chalendar |
| 5,944,253 | A | 8/1999 | Miller |
| 5,947,367 | A | 9/1999 | Miller et al. |
| 5,975,286 | A | 11/1999 | Cliff |
| 5,992,733 | A | 11/1999 | Gomes |
| 6,019,220 | A | 2/2000 | Sutherland |
| 6,019,276 | A | 2/2000 | Auclair |
| 6,021,897 | A | 2/2000 | Sutherland |
| 6,021,898 | A | 2/2000 | Sutherland |
| 6,021,899 | A | 2/2000 | Sutherland |
| D425,436 | S | 5/2000 | Wei |
| 6,065,590 | A | 5/2000 | Spivey |
| D426,154 | S | 6/2000 | De Baschmakoff |
| 6,085,969 | A | 7/2000 | Burgoyne |
| 6,105,853 | A | 8/2000 | Lamare |
| 6,105,854 | A | 8/2000 | Spivey et al. |
| 6,109,438 | A | 8/2000 | Sutherland |
| 6,109,512 | A | 8/2000 | Morrison |
| 6,112,977 | A | 9/2000 | Sutherland et al. |
| 6,129,266 | A | 10/2000 | Oliff et al. |
| 6,131,803 | A | 10/2000 | Cliff et al. |
| 6,155,480 | A | 12/2000 | Botsford et al. |
| 6,158,586 | A | 12/2000 | Muller |
| 6,164,526 | A | 12/2000 | Dalvey |
| D436,859 | S | 1/2001 | Botsford |
| 6,170,741 | B1 | 1/2001 | Skolik et al. |
| 6,176,419 | B1 | 1/2001 | Holley, Jr. |
| 6,202,920 | B1 | 3/2001 | Auclair |
| 6,206,277 | B1 | 3/2001 | Correll |
| 6,206,279 | B1 | 3/2001 | Countee |
| 6,227,367 | B1 | 5/2001 | Harrelson et al. |
| 6,260,755 | B1 | 7/2001 | Bates et al. |
| 6,289,651 | B1 | 9/2001 | Le Bras |
| 6,290,122 | B1 | 9/2001 | Correll |
| 6,302,320 | B1 | 10/2001 | Stout |
| 6,315,123 | B1 | 11/2001 | Ikeda |
| D452,154 | S | 12/2001 | Rhodes et al. |
| D456,253 | S | 4/2002 | Bryan |
| 6,364,199 | B1 | 4/2002 | Rose |
| 6,371,365 | B1 | 4/2002 | Doucette et al. |
| 6,375,066 | B1 | 4/2002 | Ritter |
| 6,409,077 | B1 | 6/2002 | Telesca et al. |
| 6,425,520 | B1 | 7/2002 | Peterson |
| D469,691 | S | 2/2003 | Brondyke |
| D470,769 | S | 2/2003 | Holthaus |
| 6,523,739 | B2 | 2/2003 | Heeley et al. |
| 6,536,656 | B2 | 3/2003 | Auclair et al. |
| 6,550,616 | B2 | 4/2003 | Le Bras |
| 6,571,539 | B2 | 6/2003 | Gendre et al. |
| 6,631,803 | B2 | 10/2003 | Rhodes et al. |
| 6,715,639 | B2 | 4/2004 | Spivey |
| D489,609 | S | 5/2004 | Holthaus |
| 6,752,262 | B1 | 6/2004 | Boriani et al. |
| 6,758,337 | B2 | 7/2004 | Chargueraud et al. |
| 6,766,940 | B2 | 7/2004 | Negelen |
| 6,811,525 | B2 | 11/2004 | Culpepper |
| 6,834,793 | B2 | 12/2004 | Sutherland |
| D502,097 | S | 2/2005 | Holthaus |
| 6,848,573 | B2 | 2/2005 | Gould et al. |
| 6,866,185 | B2 | 3/2005 | Harrelson |
| 6,866,186 | B2 | 3/2005 | Fogle et al. |
| 6,869,009 | B2 | 3/2005 | Sutherland et al. |
| 6,899,221 | B2 | 5/2005 | Skolik et al. |
| 6,905,066 | B2 | 6/2005 | Holley |

(56) References Cited

U.S. PATENT DOCUMENTS 6,926,193 B2 8/2005 Smalley
6,929,171 B1 8/2005 Thiersch
6,945,450 B2 9/2005 Rusnock
6,948,651 B2 9/2005 Ikeda
D511,248 S 11/2005 Premper
6,968,992 B2 11/2005 Schuster
D513,177 S 12/2005 Tachikawa
6,971,572 B2 12/2005 Ikeda
6,981,631 B2 1/2006 Fogle et al.
6,988,617 B2 1/2006 Gomes et al.
7,000,803 B2 2/2006 Miller
7,007,800 B2 3/2006 Le Bras
7,007,836 B2 3/2006 Smalley
7,070,045 B2 7/2006 Theelen
7,159,759 B2 1/2007 Sutherland
7,234,596 B2 6/2007 Lebras
7,237,674 B2 7/2007 Auclair
D549,575 S 8/2007 Pinkstone
D551,967 S 10/2007 Hengami
D553,496 S 10/2007 Martuch et al.
7,296,731 B2 11/2007 Auclair et al.
D558,047 S 12/2007 Pinkstone
7,331,509 B2 2/2008 Bates et al.
7,357,254 B2 4/2008 Auclair et al.
7,374,038 B2 5/2008 Smalley
7,374,043 B2 5/2008 Holley, Jr. et al.
7,380,701 B2 6/2008 Fogle et al.
7,416,109 B2 8/2008 Sutherland
7,427,010 B2 9/2008 Sutherland
7,448,492 B2 11/2008 Sutherland
D582,267 S 12/2008 Andre
7,472,791 B2 1/2009 Spivey, Sr.
D589,344 S 3/2009 Lang
7,546,924 B2 6/2009 Oliveira
7,571,807 B2 8/2009 DeBusk et al.
7,601,111 B2 10/2009 Sutherland et al.
7,621,438 B2 11/2009 Spivey, Sr.
D609,088 S 2/2010 Kvam
7,665,653 B2 2/2010 Fitzwater
D611,341 S 3/2010 Belce
7,699,215 B2 4/2010 Spivey, Sr.
7,703,666 B2 4/2010 Hand et al.
7,743,944 B2 6/2010 Ho Fung et al.
7,743,968 B2 6/2010 Theelen
7,748,603 B2 7/2010 Fogle et al.
7,757,933 B2 7/2010 Dunn
7,762,397 B2 7/2010 Coltri-Johnson
7,762,450 B2 7/2010 Oliveira
7,766,219 B2 8/2010 Gomes et al.
7,793,779 B2 9/2010 Spivey, Sr. et al.
7,806,314 B2 10/2010 Sutherland
7,874,477 B2 1/2011 Sutherland et al.
7,992,765 B2 8/2011 Brand
8,061,587 B2 11/2011 Blin
D651,075 S 12/2011 Ren
8,070,052 B2 12/2011 Spivey, Sr. et al.
D657,239 S 4/2012 Gavrilenkov
D657,950 S 4/2012 Herman
D660,143 S 5/2012 Stowe
8,191,761 B2 6/2012 Brand
8,220,701 B2 7/2012 Fontaine et al.
D670,999 S 11/2012 Stowe
8,376,214 B2 2/2013 Spivey, Sr. et al.
D684,042 S 6/2013 Betzig
8,459,533 B2 6/2013 Requena et al.
8,479,972 B2 7/2013 Craft
8,550,332 B2 10/2013 DeBusk
8,740,051 B2 6/2014 Gonzalez
8,955,736 B2 2/2015 Spivey, Sr. et al.
8,997,987 B1 4/2015 Block
D737,135 S 8/2015 Mizutani
D737,137 S 8/2015 Exner
9,096,344 B1 8/2015 Block
9,132,936 B2 9/2015 Kohler
D747,868 S 1/2016 Steka
9,392,888 B2 7/2016 Spivey, Sr.
9,415,914 B2 8/2016 Holley, Jr.
9,487,320 B2 11/2016 Holley, Jr.
9,499,319 B2 11/2016 Schmal et al.
D781,143 S 3/2017 Holley, Jr.
9,737,161 B1 8/2017 Li
D805,895 S 12/2017 Smalley et al.
D805,896 S 12/2017 Smalley
D826,711 S 8/2018 Boersma et al.
10,232,976 B2 * 3/2019 Waddington ..... B65D 5/0281
10,442,573 B1 * 10/2019 Battat ..... B65D 3/10
10,450,100 B2 * 10/2019 Caliri ..... B65D 3/26
10,492,633 B2 * 12/2019 Li ..... A47G 19/2205
10,569,926 B2 * 2/2020 Jackson ..... B65D 5/4266
10,669,061 B2 6/2020 Smalley et al.
10,676,231 B2 * 6/2020 Lu ..... B65D 3/06
2002/0070139 A1 6/2002 Bates
2002/0088820 A1 7/2002 Spivey
2002/0088821 A1 7/2002 Spivey et al.
2003/0000182 A1 1/2003 Portrait et al.
2003/0116612 A1 6/2003 Polloni et al.
2003/0132130 A1 7/2003 Bras
2003/0192905 A1 10/2003 Spivey
2003/0213263 A1 11/2003 Woog
2004/0011674 A1 1/2004 Theelen
2004/0050917 A1 3/2004 Smalley
2004/0060972 A1 4/2004 Harrelson
2004/0074954 A1 4/2004 Fogle et al.
2004/0089671 A1 5/2004 Miller
2004/0099558 A1 5/2004 Oliff et al.
2004/0164133 A1 8/2004 Harrelson
2004/0188277 A1 9/2004 Auclair
2004/0188300 A1 9/2004 Sutherland
2004/0188301 A1 9/2004 Gomes
2004/0243277 A1 12/2004 Bonnain et al.
2004/0254666 A1 12/2004 Bonnain et al.
2004/0256445 A1 12/2004 Merzeau
2004/0262374 A1 12/2004 Chargueraud
2005/0001020 A1 1/2005 Gamier
2005/0056658 A1 3/2005 Spivey
2005/0087592 A1 4/2005 Schuster
2005/0167292 A1 8/2005 Sutherland
2005/0167476 A1 8/2005 Ikeda
2005/0167478 A1 8/2005 Holley, Jr.
2005/0178687 A1 8/2005 Spivey, Sr.
2005/0178791 A1 8/2005 Miller
2005/0194430 A1 9/2005 Auclair et al.
2005/0199692 A1 9/2005 Nelson
2006/0000881 A1 1/2006 Sutherland
2006/0071058 A1 4/2006 Spivey, Sr.
2006/0108406 A1 5/2006 Stewart et al.
2006/0169755 A1 8/2006 Spivey, Sr.
2006/0191811 A1 8/2006 Fogle et al.
2006/0254942 A1 11/2006 Cargile, Jr.
2006/0255108 A1 11/2006 Shmagin
2006/0273143 A1 12/2006 Finch
2007/0039846 A1 2/2007 Spivey, Sr.
2007/0051781 A1 3/2007 Holley, Jr.
2007/0069002 A1 3/2007 Gomes et al.
2007/0090175 A1 4/2007 Schemmel
2007/0102498 A1 5/2007 Doll et al.
2007/0108261 A1 5/2007 Schuster
2007/0137222 A1 6/2007 Kastanek et al.
2007/0138242 A1 6/2007 Fitzwater
2007/0164091 A1 7/2007 Fogle et al.
2007/0164093 A1 7/2007 Spivey, Sr.
2007/0181658 A1 8/2007 Sutherland
2007/0205255 A1 9/2007 Dunn
2007/0284424 A1 12/2007 Holley
2007/0295789 A1 12/2007 Ho Fung
2008/0083820 A1 4/2008 Walling et al.
2008/0099544 A1 5/2008 Skolik
2008/0119344 A1 5/2008 Sutherland et al.
2009/0236408 A1 9/2009 Spivey, Sr.
2009/0255983 A1 10/2009 De Paula et al.
2010/0012711 A1 1/2010 Paulen
2010/0025455 A1 2/2010 Pan
2010/0108747 A1 5/2010 Brand
2010/0147933 A1 6/2010 Blin

(56) References Cited

U.S. PATENT DOCUMENTS

| | | | |
|---|---|---|---|
| 2010/0193575 | A1 | 8/2010 | Fontaine et al. |
| 2010/0213249 | A1 | 8/2010 | Requena et al. |
| 2010/0270367 | A1 | 10/2010 | Brandenburger |
| 2011/0095075 | A1 | 4/2011 | Pinkstone |
| 2011/0113733 | A1 | 5/2011 | Franic |
| 2011/0147444 | A1 | 6/2011 | Fitzwater |
| 2012/0279897 | A1 | 11/2012 | Schmal et al. |
| 2013/0181042 | A1 | 7/2013 | Conradi |
| 2013/0193196 | A1 | 8/2013 | Hallam et al. |
| 2013/0214036 | A1 | 8/2013 | Spivey, Sr. et al. |
| 2013/0220873 | A1 | 8/2013 | Holley, Jr. |
| 2013/0284628 | A1 | 10/2013 | Moncrief et al. |
| 2014/0260095 | A1 | 9/2014 | Oliveira |
| 2014/0305826 | A1 | 10/2014 | Holley, Jr. |
| 2015/0001116 | A1 | 1/2015 | Schmal et al. |
| 2015/0151888 | A1 | 6/2015 | Fitzwater et al. |
| 2016/0114933 | A1 | 4/2016 | Smalley |
| 2016/0244231 | A1 | 8/2016 | Alexander et al. |
| 2017/0101240 | A1 | 4/2017 | Boersma |
| 2018/0050836 | A1 | 2/2018 | Shafer |

FOREIGN PATENT DOCUMENTS

| | | | |
|---|---|---|---|
| CA | 877792 | | 8/1971 |
| CA | 2 135 930 | | 10/1994 |
| CA | 2 160 145 | | 9/1995 |
| CA | 118620 | | 12/2007 |
| CA | 122012 | | 7/2008 |
| CA | 126100 | | 12/2008 |
| CA | 129892 | | 12/2009 |
| CA | 131063 | | 3/2010 |
| CA | 131481 | | 3/2010 |
| CA | 132220 | | 5/2010 |
| CA | 133757 | | 9/2010 |
| CA | 136756 | | 9/2010 |
| CA | 166826 | | 10/2016 |
| CA | 169768 | | 3/2017 |
| CA | 171618 | | 7/2017 |
| DE | 1 192 099 | | 4/1965 |
| DE | 85 14 718.4 | | 6/1985 |
| DE | 91 04 905.9 | | 6/1991 |
| DE | 92 03 858.1 | | 5/1992 |
| DE | 93 20 302 | | 5/1994 |
| DE | 295 04 256 | | 5/1995 |
| DE | 296 07 374 | | 4/1996 |
| DE | 201 12 228 | | 11/2002 |
| DE | 20 2004 018 649 | | 4/2005 |
| EP | 0 341 089 | | 11/1989 |
| EP | 0 412 226 | | 2/1991 |
| EP | 0 459 658 | | 12/1991 |
| EP | 0 473 266 | | 3/1992 |
| EP | 0 475 147 | | 3/1992 |
| EP | 0 509 749 | | 10/1992 |
| EP | 0 520 411 | | 12/1992 |
| EP | 0 950 617 | | 10/1999 |
| EP | 1 260 448 | | 11/2002 |
| EP | 1 262 417 | | 12/2002 |
| EP | 1 518 792 | | 3/2005 |
| EP | 1 612 157 | | 1/2006 |
| EP | 1 661 813 | | 5/2006 |
| EP | 1 613 537 | | 11/2009 |
| EP | 2 271 558 | | 1/2015 |
| FR | 1 494 239 | | 9/1967 |
| FR | 2 163 317 | | 7/1973 |
| FR | 2 549 010 | | 1/1985 |
| FR | 2 579 175 | | 9/1986 |
| FR | 2 581 970 | | 11/1986 |
| FR | 2 698 074 | | 5/1994 |
| GB | 1 317 667 | | 5/1973 |
| JP | 06-32320 | | 4/1994 |
| JP | 8-503187 | | 4/1996 |
| JP | 2003-95243 | | 4/2003 |
| JP | 2005-507831 | | 3/2005 |
| JP | 2010-013141 | A | 1/2010 |
| JP | 2016-204043 | A | 12/2016 |
| KR | 20-0356729 | | 7/2004 |
| KR | 20-0438755 | Y1 | 3/2008 |
| WO | WO 94/10047 | | 5/1994 |
| WO | WO 96/27538 | | 9/1996 |
| WO | WO 96/29260 | | 9/1996 |
| WO | WO 97/27124 | | 7/1997 |
| WO | WO 98/39220 | | 9/1998 |
| WO | WO 99/28207 | | 6/1999 |
| WO | WO 99/64301 | | 12/1999 |
| WO | WO 00/78618 | | 12/2000 |
| WO | WO 01/44077 | | 6/2001 |
| WO | WO 01/66434 | | 9/2001 |
| WO | WO 02/30785 | | 4/2002 |
| WO | WO 02/102208 | | 12/2002 |
| WO | WO 03/008292 | | 1/2003 |
| WO | WO 03/037742 | | 5/2003 |
| WO | WO 03/082686 | | 10/2003 |
| WO | WO 2004/043790 | | 5/2004 |
| WO | WO 2005/080218 | | 9/2005 |
| WO | WO 2005/042370 | | 12/2005 |
| WO | WO 2005/123532 | | 12/2005 |
| WO | WO 2007/089282 | | 8/2007 |
| WO | WO 2010/014438 | | 2/2010 |
| WO | WO 2012/009502 | | 1/2012 |
| WO | WO 2013/177072 | | 11/2013 |
| WO | WO 2014/045066 | A1 | 3/2014 |
| WO | WO 2014/161684 | | 10/2014 |
| WO | WO 2014/186259 | | 11/2014 |
| WO | WO 2016/069534 | | 5/2016 |
| WO | WO 2016/099969 | | 6/2016 |

OTHER PUBLICATIONS

Graphic Packaging, Rounded Corner fridge pack, 2015 [earliest online date], [site visited Aug. 9, 2017], Available from Internet, <URL:https://www.graphicpkgeurope.com/beverage/product-lines/fully-enclosed-carton-fec/>.

Deline Box and Display, Produce Packaging, 2017 [earliest online date], [site visited Aug. 9, 2017], Available from Internet, <URL:http://www.delinebox.com/success-stories/produce>.

Curved Corners, Fancy Packaging, Apr. 8, 2016 [earliest online date], [site visited Nov. 7, 2017], Available from Internet, <URL:http://nextindustry.net/curved-angles-fancy-packaging/> (Year: 2016).

Youtube, Bent Plywood in 7 Easy Steps by prusso37, Apr. 7, 2009 [earliest online date], [site visited Nov. 7, 2017], Available from Internet, <URL:https://www.youtube.com/watch?v=TXAeLwJ8fcw> (Year: 2009).

Youtube, Curved Box Joint by Matthias Wandel, Sep. 16, 2016 [earliest online date], [site visited Nov. 7, 2017], Available from Internet, <URL:https://www.youtube.com/watch?v=VtQ447rQx_o>. (Year: 2016).

Amazon, Eduplay 210201 Bastelset fur Kinder: Koffer, Jul. 16, 2015 [earliest online date], [site visited Nov. 7, 2017], Available from Internet, <URL:https://www.amazon.de/EDUPLAY-Eduplay-Kinderkoffer-zum--Selbstgestalten/dp/B06Y37T66Y?language=en_GB>. (Year: 2015).

Wholesale round bottom take away box. [online] Retrieved Jun. 3, 20 from URL: https://ebelee.en.alibaba.com/product/62016225750-218175390/Wholesale_16oz_26oz_32oz_round_bottom_take_away_paper_noodle_pasta_doner_kebab_box.html.

Notice of Allowance for U.S. Appl. No. 29/689,508, dated Jul. 8, 2020.

* cited by examiner

CARTON FOR AN ARTICLE

CROSS-REFERENCE TO RELATED APPLICATIONS

This application claims the benefit of U.S. Provisional Patent Application No. 62/837,337, filed on Apr. 23, 2019, and is a continuation of U.S. Design patent application No. 29/689,508, filed on Apr. 30, 2019.

INCORPORATION BY REFERENCE

The disclosures of each of U.S. Provisional Patent Application No. 62/837,337, filed on Apr. 23, 2019, and U.S. Design patent application No. 29/689,508, filed on Apr. 30, 2019, are hereby incorporated by reference for all purposes as if presented herein in their entirety.

BACKGROUND OF THE DISCLOSURE

The present disclosure generally relates to cartons for holding and dispensing products or articles such as hardware products, household products (e.g., charcoal briquettes, etc.) or automotive products, e.g., oil filters, air filters, etc.

SUMMARY OF THE DISCLOSURE

According to one aspect of the disclosure, a carton for holding at least one article comprises a plurality of panels extending at least partially around an interior of the carton, the plurality of panels comprising a front panel, a back panel, and at least one side panel. The carton further comprises at least one top end flap foldably connected to a panel of the plurality of panels, the at least one top end flap is for forming a closed top of the carton, and at least one bottom end flap foldably connected to a panel of the plurality of panels, the at least one bottom end flap is for forming a closed bottom of the carton. The closed top of the carton has a square configuration and the closed bottom has a round configuration.

According to another aspect of the disclosure, a blank for forming a carton for holding at least one article comprises a plurality of panels for extending at least partially around an interior of the carton formed from the blank, the plurality of panels comprising a front panel, a back panel, and at least one side panel. The blank further comprises at least one top end flap foldably connected to a panel of the plurality of panels, the at least one top end flap is for forming a closed top of the carton formed from the blank, and at least one bottom end flap foldably connected to a panel of the plurality of panels, the at least one second end flap is for forming a closed bottom of the carton formed from the blank such that the closed top of the carton formed from the blank has a square configuration and the closed bottom formed from the blank has a round configuration.

According to another aspect of the disclosure, a method of forming a carton for holding at least one article includes obtaining a blank comprising a plurality of panels comprising a front panel, a back panel, and at least one side panel, the blank further comprising at least one top end flap foldably connected to a panel of the plurality of panels, and at least one bottom end flap foldably connected to a panel of the plurality of panels. The method further comprises folding the plurality of panels at least partially around an interior of the carton, folding the at least one top end flap to form a closed top of the carton, and folding the at least one bottom end flap to form a closed bottom of the carton such that the closed top of the carton has a square configuration and the closed bottom has a round configuration.

Other aspects, features, and details of the present disclosure can be more completely understood by reference to the following detailed description of exemplary embodiments taken in conjunction with the drawings and from the appended claims.

Those skilled in the art will appreciate the above-stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons (e.g., carriers) with features for containing and facilitating dispensing products or articles such as hardware products or automotive products, e.g., oil filters, air filters, etc. The cartons described herein can contain other types of products, e.g., food products or non-food products, without departing from the disclosure. In this specification, the terms "inner," "interior," "outer," "exterior," "lower," "bottom," "upper," and "top" indicate orientations determined in relation to fully erected and upright cartons.

As described herein, cartons may be formed by multiple overlapping panels, end flaps, and/or other portions of blanks. Such panels, end flaps, and/or other portions of the blanks can be designated in relative terms to one another, e.g., "first", "second", "third", etc., in sequential or non-sequential reference, without departing from the disclosure.

Figure 1:
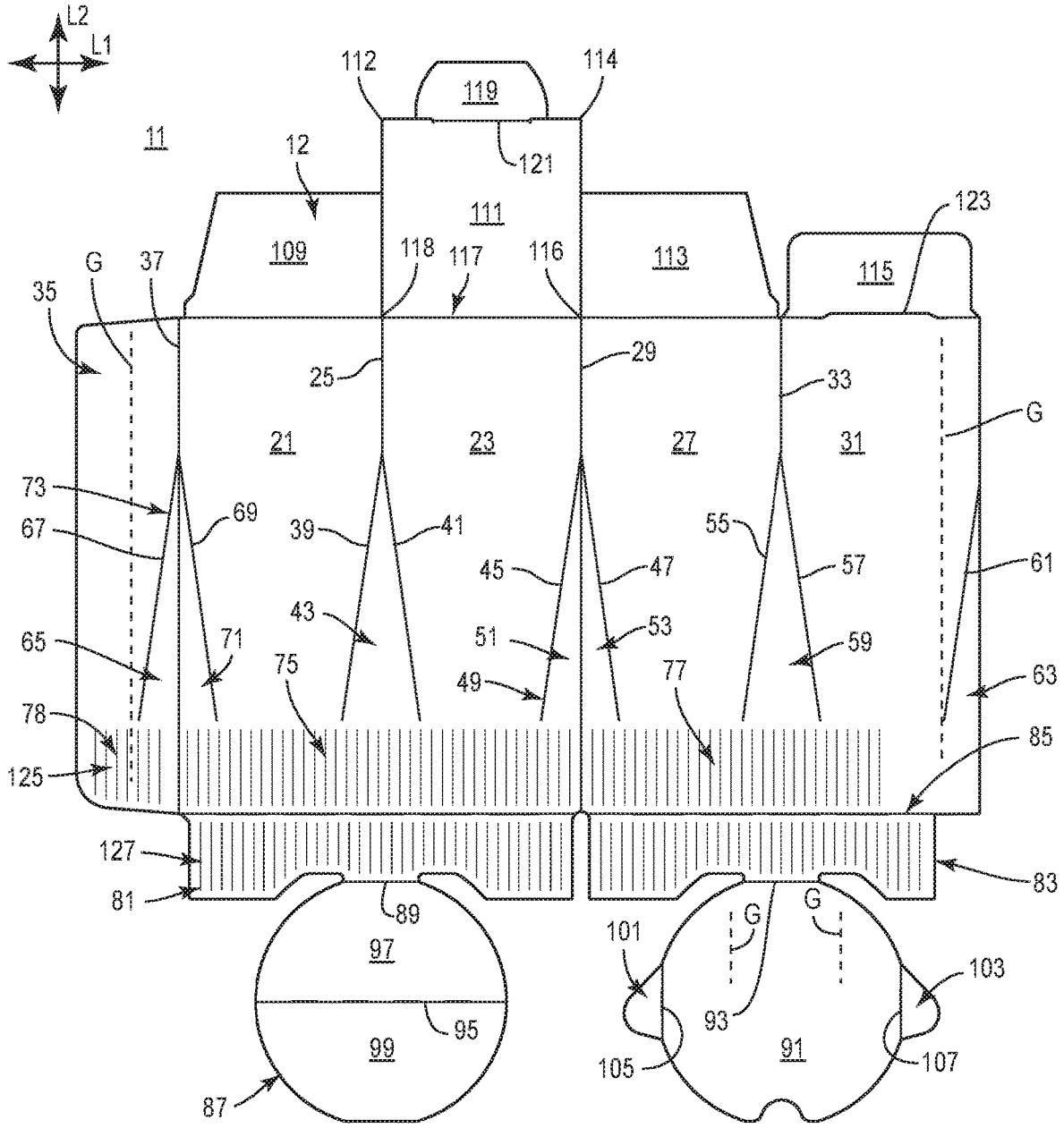
FIG. 1 is a plan view of an exterior surface of a blank for forming a carton according to a first exemplary embodiment of the disclosure.
Figure 10:
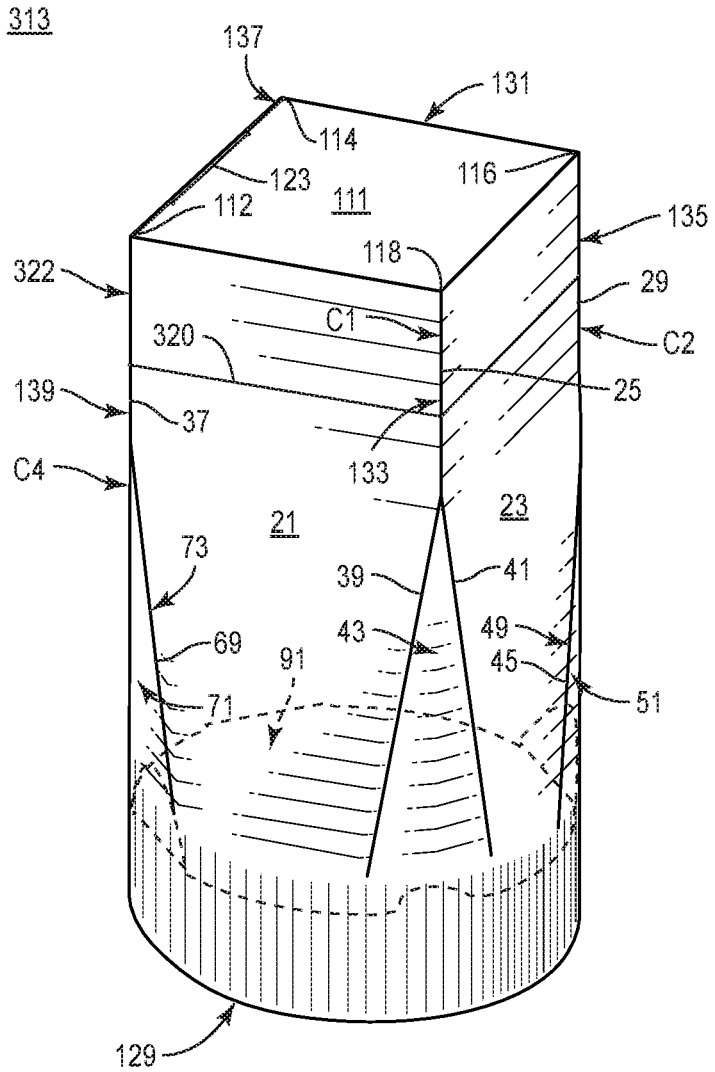
FIG. 10 is a perspective view of a carton formed from the blank of FIG. 9.

FIG. 1 is a plan view of an exterior surface 12 of a blank, generally indicated at 11, used to form a carton 13 (FIG. 10)

according to a first exemplary embodiment of the disclosure. The carton 13 can be used to hold a product such as a hardware product, an automotive product such as an oil filter, air filter, etc., or other consumer product, e.g., charcoal briquettes, to name a few, in an interior 15 of the carton 13. The carton 13 can hold other types of articles or products without departing from the disclosure.

In the illustrated embodiment, the blank 11 has a longitudinal axis L1 and a lateral axis L2. The blank 11 includes a plurality of panels, which include a first side panel 21 foldably connected to a front panel 23 at a lateral fold line 25, a second side panel 27 foldably connected to the front panel 23 at a lateral fold line 29, and a back panel 31 foldably connected to the second side panel 27 at a lateral fold line 33. An attachment flap 35 can be foldably connected to the first side panel 21 at a lateral fold line 37.

The blank 11 can also include a plurality of lower corner portions foldably connected to respective panels of the plurality of panels of the blank 11. As shown, a first lower corner portion 43 is foldably connected to the first side panel 21 at an oblique fold line 39 and is foldably connected to the front panel 23 at an oblique fold line 41. The oblique fold lines 39, 41 converge at a point of intersection with the lateral fold line 25, and the first lower corner portion 43 is at least partially defined between the oblique fold line 39, 31.

A second lower corner portion 49, as shown, is foldably connected to the front panel 23 at an oblique fold line 45 and to the second side panel 27 at an oblique fold line 47. The oblique fold lines 45, 47 converge at a point of intersection with the lateral fold line 29 to at least partially define the second lower corner portion 49 between the oblique fold lines 45, 47. As also shown, the lateral fold line 29 bisects the second lower corner portion 49 to define respective first and second sections 51, 53 that are foldably connected at the fold line 29. In this regard, the first section 51 of the lower corner portion 49 is foldably connected to the front panel 23 at the oblique fold line 45, and the second section 53 of the second lower corner portion 49 is foldably connected to the second side panel 27 at the oblique fold line 47.

Still referring to FIG. 1, a third lower corner portion 59 is foldably connected to the second side panel 27 at an oblique fold line 55, and the third lower corner portion 59 is foldably connected to the back panel 31 at an oblique fold line 57. The oblique fold lines 57, 59 converge at a point of intersection with the lateral fold line 33, and the lower corner portion 59 is at least partially defined between the oblique fold lines 57, 59.

As also shown, an interior lower corner section 63 is foldably connected to the back panel 31 at an oblique fold line 61.

As shown in FIG. 1, a fourth lower corner portion 73 is foldably connected to the attachment flap 35 at an oblique fold line 67 and is foldably connected to the first side panel 21 at an oblique fold line 69. The oblique fold lines 67, 69 converge at a point of intersection with the lateral fold line 37, and the fourth lower corner portion 73 is at least partially defined between the oblique fold lines 67, 69. The lateral fold line 37 can bisect the lower corner portion 73 to define respective first and second sections 65, 71 that are foldably connected at the fold line 37.

As described further herein, the first section 65 of the lower corner portion 73 is an exterior section 65 for overlapping, e.g., at least partial face-to-face contact, with the interior lower corner section 63 when the carton 13 is formed from the blank 11.

In this regard, the lower corner portion 43 is positioned between the first side panel 21 and the front panel 23, the lower corner portion 49 is positioned between the front panel 23 and the second side panel 27, the lower corner portion 59 is positioned between the second side panel 27 and the back panel 31, and the lower corner portion 73 is positioned between the back panel 31 and the first side panel 12.

In an alternative embodiment, the fourth lower corner portion 73 can include the interior lower corner section 63, or the section 63 can be omitted without departing from the disclosure.

As also shown, the oblique fold lines 69, 39, 41, 45 can have endpoints that are spaced above respective bottom edges of the first side panel 21 and the front panel 23. In this regard, a common or substantially uninterrupted bottom portion 75 of the respective first side panel 21 and the front panel 23 can be defined between the lateral fold lines 37, 29. Similarly, the oblique fold lines 47, 55, 57, 61 can have lower endpoints that are spaced above respective bottom edges of the respective second side panel 27 and the back panel 31 such that a common or substantially uninterrupted bottom portion 77 of the second side panel 27 and the back panel 31 can be defined between the lateral fold line 29 and a free edge of the back panel 31. In one embodiment, the respective lower corner portions 43, 49, 59, 73 can include respective portions of the respective common bottom portions 75, 77.

A first plurality of spaced lateral fold lines 125, as shown, can be disposed on one or both of the common bottom portions 75, 77 and can also be disposed on a bottom portion of the attachment flap 35.

A first bottom reinforcement panel 81, as shown, is foldably connected to the first side panel 21 and the front panel 23 at respective portions of a longitudinal fold line 85 such that the first bottom reinforcement panel 81 is foldably connected to the common bottom portion 75 of the first side panel 21 and the front panel 23. Similarly, a second bottom reinforcement panel 83 is foldably connected to the common bottom portion 77 of the second side panel 27 and the back panel 31 at a respective portion of the fold line 85.

Further, a second plurality of spaced lateral fold lines 127 can be disposed on one or both of the bottom reinforcement panels 81, 83. It will be understood that one or both of the pluralities of fold lines 125, 127, or any one or more individual fold line thereof, can be provided in a different number, arrangement, orientation (e.g., an oblique orientation) or other configuration or dimension without departing from the disclosure.

With continued reference to FIG. 1, a first bottom end flap 87 is foldably connected to the first bottom reinforcement panel 81 at a longitudinal fold line 89 and a second bottom end flap 91 is foldably connected to the second bottom reinforcement panel 83 at a longitudinal fold line 93 such that the bottom end flaps 87, 91 are disposed along a bottom marginal portion of the blank 11. A longitudinal fold line 95 can bisect the bottom end flap 87 into a first section 97 foldably connected to the bottom reinforcement panel 81 at the fold line 89, and a second section 99 foldably connected to the first section 97 at the fold line 95. In the illustrated embodiment, a pair of extension flaps 101, 103, as shown, are foldably connected to the second bottom end flap 91 at respective lateral fold lines 105, 107.

In the illustrated embodiment, a first side top end flap 109 is foldably connected to the first side panel 21 at a respective portion of a longitudinal fold line 117, and a front top end flap 111 is foldably connected to the front panel 23 at a respective portion of the fold line 117. The front top end flap 111 has a generally square or orthogonal configuration including generally orthogonal corners 112, 114, 116, 118.

As also shown, a second side top end flap 113 is foldably connected to the second side panel 27 at a respective portion of the fold line 117, and a back top end flap 115 is foldably connected to the back panel 31 at a respective portion of the fold line 117. In this regard, the top end flaps 109, 111, 113, 115 are disposed along a top marginal portion of the blank 11.

The blank 11/carton 13 formed therefrom can also include closure or locking features that include a locking tab 119 foldably connected to the front top end flap 111 at a longitudinal fold line 121, and which is for at least partial insertion through a cut 123 that interrupts the fold line 117 adjacent the back top end flap 115. In an alternative embodiment, the blank 11/carton 13 can be devoid of top end flaps or closure features without departing from the disclosure.

One or more of the panels, flaps, or other features of the blank 11 can have a different shape, dimension, arrangement, or configuration without departing from the disclosure. For example, in an alternative configuration of the blank 11, a coating can be provided on both the interior surface 14 (FIG. 2) and the exterior surface 12 of the blank 11.

Figure 2:
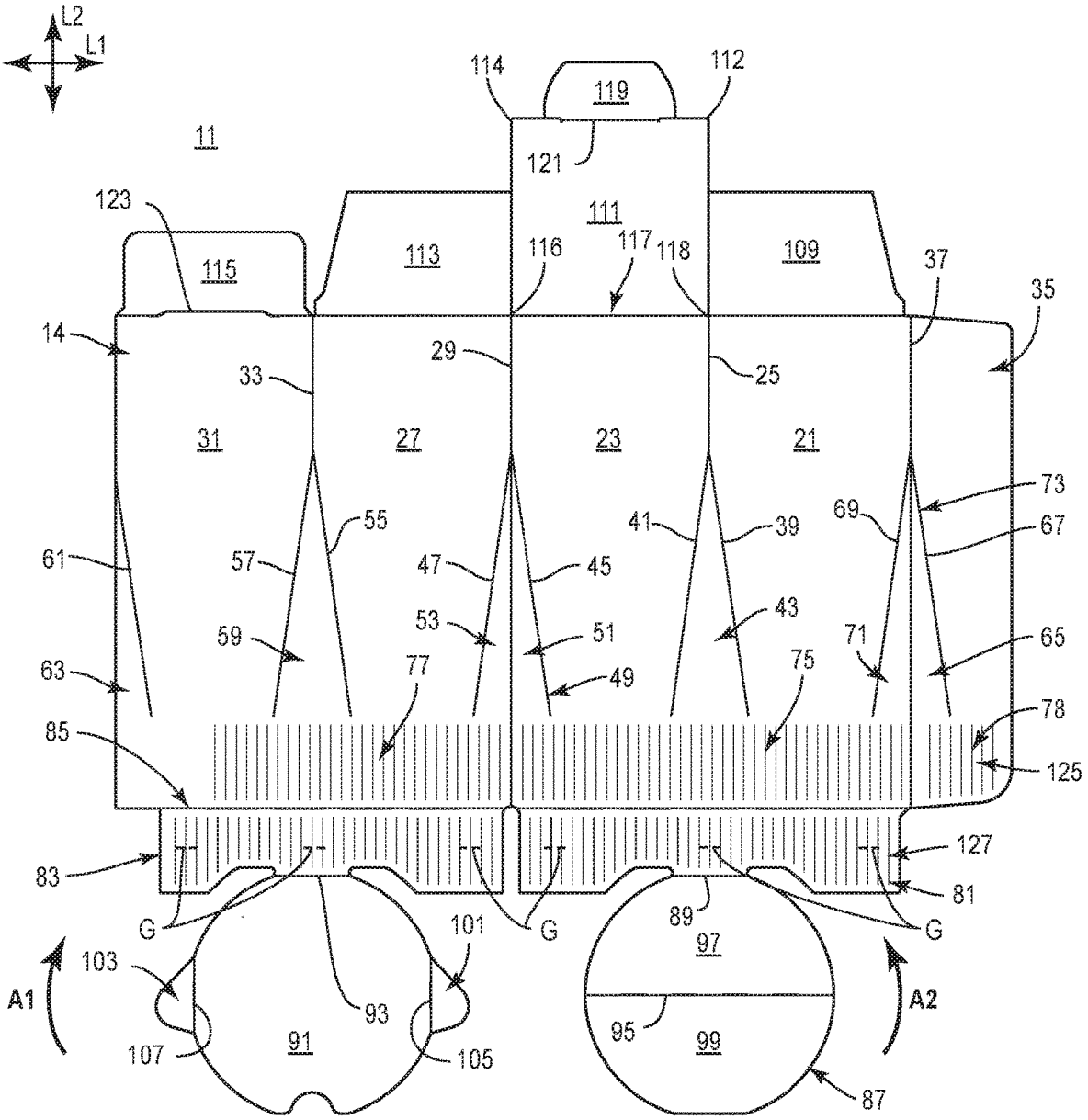
FIG. 2 is a plan view of an interior surface of the blank of FIG. 1.
Figure 3:
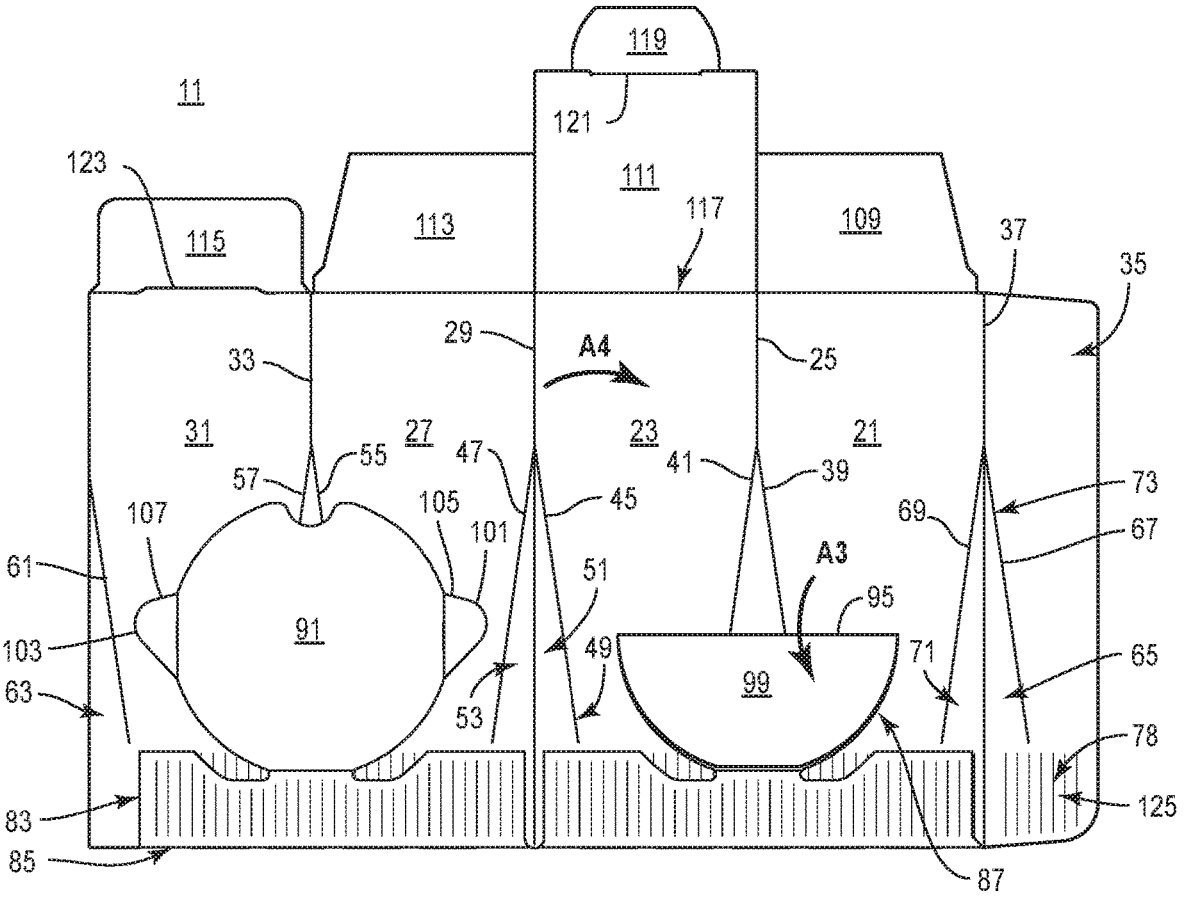
FIG. 3 is a plan view of the blank of FIG. 1 in a partially folded configuration.

Referring additionally to FIGS. 2 and 3, formation of the carton 13 from the blank 11 according to one exemplary embodiment of the disclosure will be described. As shown in FIG. 2, the blank 11 can be positioned with the exterior surface 12 facing down, e.g., such that an interior surface 14 thereof is facing up, and the second bottom reinforcement panel 83 can be folded upwardly at a respective portion of the fold line 85 in the direction of the arrow A1 such that the bottom reinforcement panel 83 is in at least partial face-to-face contact with respective portions of the second side panel 27 and the back panel 31, e.g., the bottom portion 77, and such that the second bottom end flap 91 is also carried into at least partial face-to-face contact with respective portions of the second side panel 27, the back panel 31, and the lower corner portion 59.

Simultaneously or thereafter, the first bottom reinforcement panel 81 can be folded at a respective portion of the fold line 85 in the direction of the arrow A2 and into at least partial face-to-face contact with the respective portions of the first side panel 21 and the front panel 23, e.g., the bottom portion 75, and the folded first bottom end flap 87 can be carried into overlapping relation with respective portions of the first side panel 21, the front panel 23, and the lower corner portion 43, e.g. such that the first section 97 is in at least partial face-to-face contact with respective portions of the first side panel 21, the front panel 23, and the lower corner portion 43.

As shown in FIG. 3, the second section 99 of the first bottom end flap 87 can be engaged, for example, by a machine finger, pincer, or other engagement structure, such that the exterior surface of the second section 99 is folded at the fold line 95 in the direction of the arrow A3 into at least partial face-to-face contact with the exterior surface of the first section 97.

Thereafter, the second side panel 27 can be folded at the fold line 29 in the direction of the arrow A4 and into at least partial face-to-face contact with the front panel 23, and the back panel 31 can thereby be carried into at least partial face-to-face contact with the first side panel 21. To maintain such an arrangement, the attachment flap 35 can be folded at the fold line 37 into at least partial face-to-face contact with the back panel 31, and can be attached thereto with an adhesive such as glue G (FIG. 1). The exterior surface of the second bottom end flap 91 can also be provided with a region of glue G such that the exterior surface of the second bottom end flap 91 can be adhered to the interior surface of the second section 99 of the first bottom end flap 87.

Figure 4:
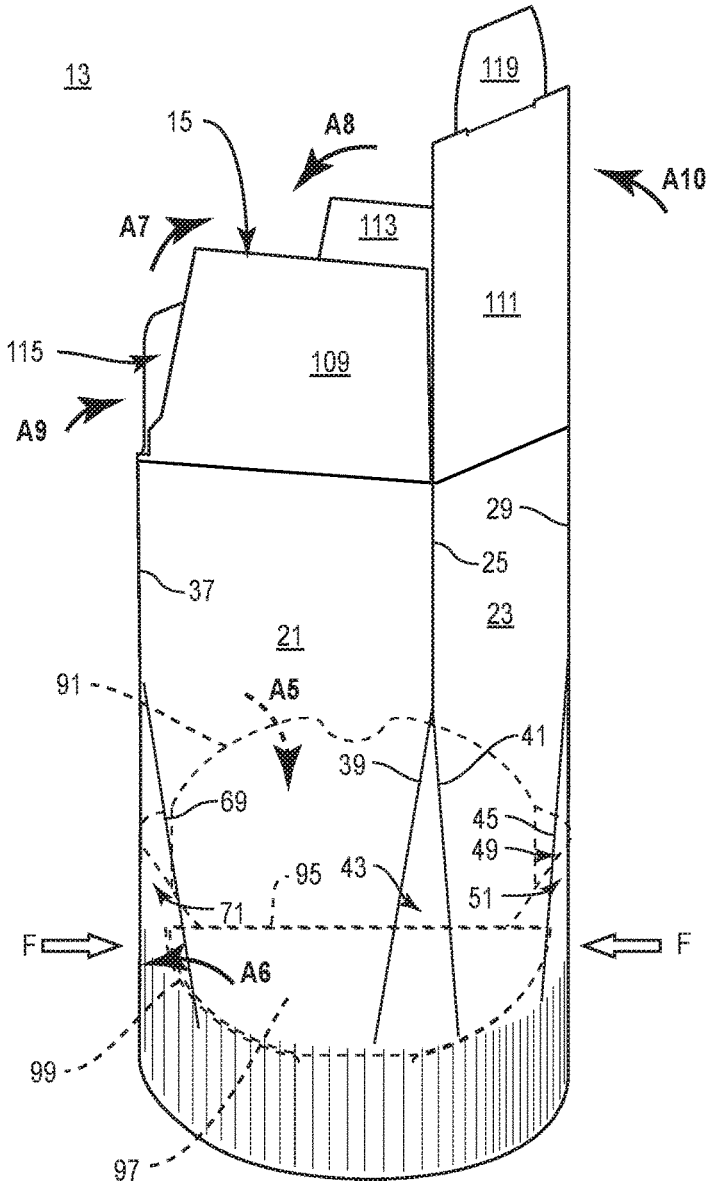
FIG. 4 is a perspective view of a formation of a carton from the blank of FIG. 1.

With reference to FIG. 4, in a first or collapsed configuration of the carton 13, a user or machine part can grasp the carton 13 proximate the fold lines 29, 37 and apply compressive forces F thereto such that the carton 13 expands toward a second or erected configuration in which the second side panel 27 and the back panel 31 are urged away from the first side panel 21 and the front panel 23 to define the interior 15 of the carton 13.

During such expansion of the carton 13 toward the erected configuration, the pluralities of spaced lateral fold lines 125 on the respective bottom reinforcement panels 81, 83 and the plurality of spaced lateral fold lines 127 on the respective bottom portions 75, 77 (and a bottom portion 78 of the attachment flap 35) provide for flexible reconfiguration thereof to form a round bottom 129 (e.g., circular, rounded or generally round) of the carton 13, e.g., such that the rounded bottom 129 of the carton 13 has a substantially circular cross-sectional profile when viewed from below. It will be understood that the carton bottom 129 can have a different cross-sectional profile that includes one or more curved portions or rounded portions, for example, ovoid, elliptical, semi-circular, etc.

Further, as the carton 13 is expanded to the erected configuration, the panels 21, 23, 27, 31 and/or the lower corner portions 43, 49, 59, 73 can urge the second bottom end flap 91 downwardly at the fold line 93 in the direction of the arrow A5 such that the second section 99 of the first bottom end flap 87, which is adhered or otherwise attached thereto, is urged to fold upwardly/outwardly at the fold line 95 in the direction of the arrow A6. Such movement of the second section 99 of the first bottom end flap 87 draws the first section 97 to fold downwardly at the fold line 89 and outwardly toward a planar alignment with the second section 99.

It will be understood that the downward folding of the second bottom end flap 91 at the fold line 93 can be facilitated by upward folding of the extension flaps 101, 103 at the respective fold lines 105, 107 to provide smooth, e.g., relatively low friction, surfaces that can minimize frictional resistance with interior surfaces of one or more the panels 21, 23, 27, 31 and/or the lower corner portions 43, 49, 59, 73 as the bottom end flap 91 moves downwardly. The free edges of the bottom reinforcement panels 81, 83 can provide an engagement edge or stop for the downward movement of the bottom end flaps 87, 91.

In this regard, the overlapped bottom end flaps 87, 91 provide a bottom panel 92 that forms a closed configuration of the generally rounded carton bottom 129, and which can be formed through squeezing or by compressing on opposing portions of the carton 13 by a user. Such an easily reconfigurable arrangement, e.g., an at least partially automatic rearrangement of the carton bottom 129, of the carton 13 allows the carton 13 to be easily transitioned between the collapsed configuration (FIG. 4), e.g., for transport or storage, and the erected configuration (FIG. 6) in which the interior 15 is provided to receive one or more articles therein.

In the erected configuration of the carton 13, the panels 21, 23, 27, 31 and the lower corner portions 43, 49, 53, 73 are arranged to surround or circumscribe the circular/round bottom end flaps 87, 91/bottom panel 92.

Figure 5:
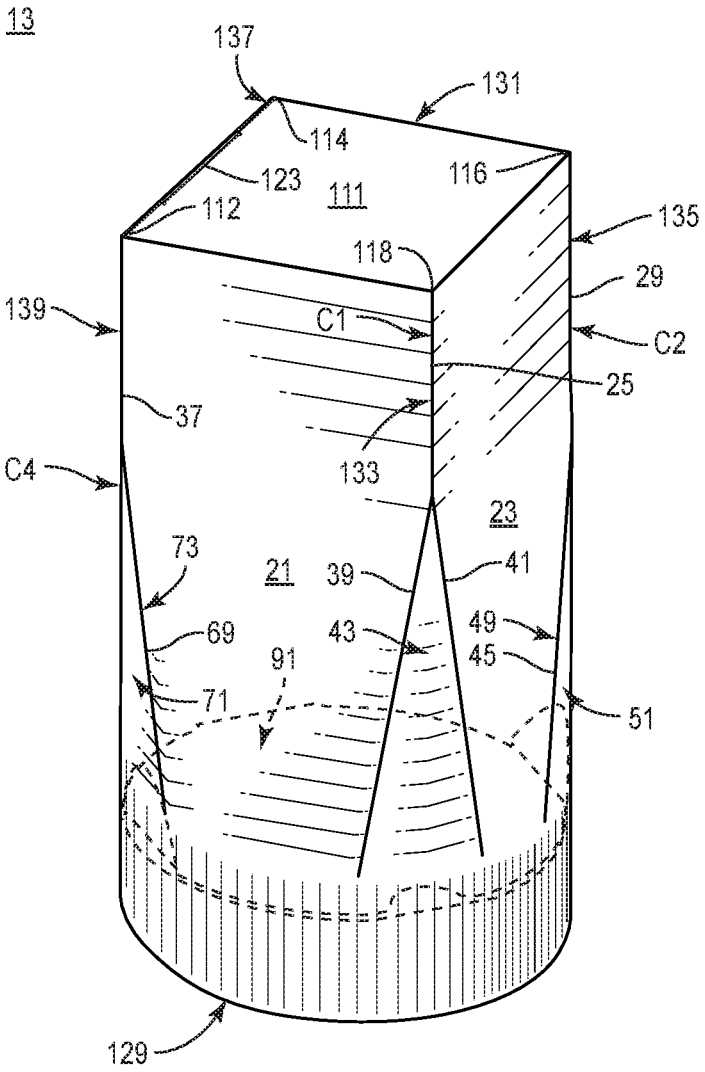
FIG. 5 is a perspective view of a carton formed from the blank of FIG. 1.
Figure 6:
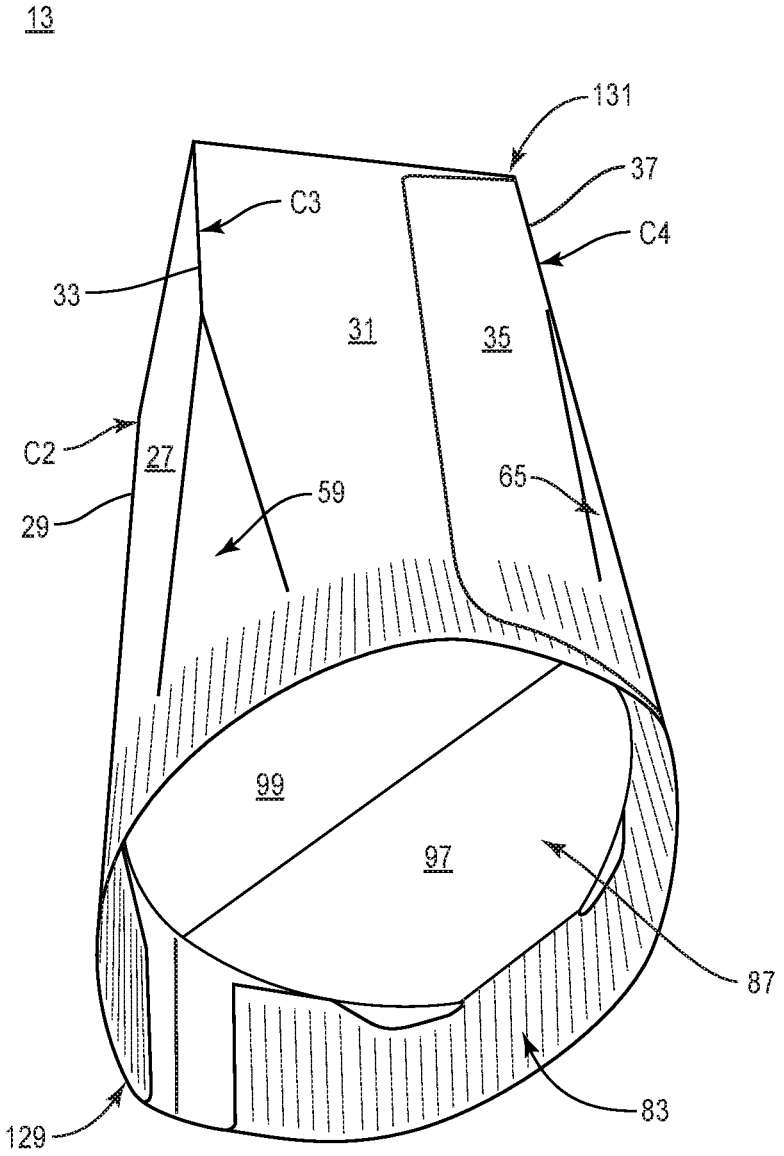
FIG. 6 is another perspective view of the carton of FIG. 5.

As shown in FIGS. 5 and 6, the carton 13 is provided with the generally round carton bottom 129 and a generally rectangular top or square top 131 formed by at least the substantially orthogonal arrangement of respective upper portions of the front panel 23 and the first side panel 21 at the fold line 25 to define a first upper corner portion 133 between the panels 21, 23 with an orthogonal configuration, the substantially orthogonal arrangement of respective upper portions of the front panel 23 and the second side panel 27 at the fold line 29 to define a second upper corner portion 135 between the panels 23, 27 with an orthogonal configuration, the substantially orthogonal arrangement of respective upper portions of the second side panel 27 and the back panel 31 at the fold line 133 to define a third upper corner portion 137 between the panels 27, 31 with an orthogonal configuration, and the substantially orthogonal arrangement of respective upper portions of the back panel 31 and the first side panel 21/attachment flap 35 at the fold line 37 to define a fourth upper corner portion 139 between the panels 21, 31 with an orthogonal configuration.

The generally square top 131 of the carton 13 can be provided in a closed configuration by downward folding of the top end flaps 109, 113 at respective portions of the fold line 117 in the direction of the respective arrows A7, A8, the downward folding of the top end flap 115 into at least partial face-to-face contact with the top end flaps 109, 113 at a respective portion of the fold line 117 in the direction of the arrow A9, and downward folding of the top end flap 111 at a respective portion of the fold line 117 in the direction of the arrow A10 and into at least partial face-to-face contact with the top end flap 115. As shown, the arrangement of the upper corner portions 133, 135, 137, 139 generally corresponds to, e.g., conforms to, the corners 112, 114, 116, 118 of the top end flap 111.

Such a closed configuration of the top 131 of the carton 13 can be maintained with locking features, for example, at least partial folding of the locking tab 119 at the fold line 121 and at least partial insertion through the cut 123. It will be understood that the carton top 131 can be provided in a different shape, arrangement, or configuration without departing from the disclosure. For example, the carton 13 can be provided with a configuration that tapers toward a top thereof, or panels or flaps of the carton 13 can be provided with tapered or angled configurations to provide additional shaped features of the carton 13.

It will be further understood that the carton top 131 can be provided with or without locking features, and which can have a different configuration than described herein without departing from the disclosure. For example, the top end flaps 109, 111, 113, 115 can be attached to one another with an adhesive such as glue, and/or can be provided with a zipper closure or other dispending feature, etc., without departing from the disclosure.

Still referring to FIGS. 5 and 6, the lower corner portion 43 extends from the rounded carton bottom 129 to the upper corner portion 133, the lower corner portion 49 extends from the rounded carton bottom 129 to the upper corner portion 135, the lower corner portion 59 extends from the rounded carton bottom 129 to the upper corner portion 137, and the lower corner portion 73 extends from the rounded carton bottom 129 to the upper corner portion 139.

In this regard, the upper corner portion 133 and the lower corner portion 43 together form a first corner C1 of the carton 13, the upper corner portion 135 and the lower corner portion 49 together form a second corner C2 of the carton 13, the upper former portion 137 and the lower corner portion 59 together form a third corner C3 of the carton 13 and the upper corner portion 139 and the lower corner portion 73 together form a fourth corner C4 of the carton 13. The corners C1, C2, C3, C4 thus extend from the square carton top 131 to the rounded carton bottom 129 of the carton 13.

As described herein, the lower corner portions 43, 49, 59, 73 provide respective regions of transition along the carton 13 from the rounded carton bottom 129 to the square carton top 131. Such transition is facilitated by the generally spaced arrangement of the respective fold lines 39, 41; 45, 47; 55, 57; 61/67, 69 at respective bottom regions thereof that are spaced above and accommodate the curvature of the rounded carton bottom 129. The respective fold lines 39, 41; 45, 47; 55, 57; 61/67, 69 converge as they extend upwardly to intersect the respective fold lines 25, 29, 33, 37 to form the respective upper corner portions 133, 135, 137, 139.

As illustrated, the lower corner portions 43, 49, 59, 73 can have an at least partially curved or rounded configuration, though the corner features can have other configurations, e.g., chamfered or obliquely-angled or beveled, without departing from the disclosure.

In this regard, the generally rounded carton bottom 129 can be configured to accommodate a generally round article, e.g., a hardware article, household article such as a charcoal briquette, or automotive article such as an air filter or oil filter, in the interior 15 thereof, and the square carton top 131 is provided with a closure configuration via the top end flaps 109, 111, 113, 115 and optional locking features.

Such a versatile arrangement of the carton 13, e.g., having an asymmetrical top and bottom, can obviate concerns over some carton arrangements with a generally rounded bottom, e.g., a carton arrangement that lacks the transition features of the lower corner portions 43, 49, 59, 73, such that a rounded top is also provided that can involve the application of, for example, specialized closure features, e.g., removable plastic lids, fitments, etc. In addition, the arrangement of the carton top 131 is such that the top end flap 111 provides an easily visible surface that can be used as a billboard, e.g., a region of the carton 13 upon which printed graphics or other indicia related to a product or retailer can be provided. Furthermore, the carton 13 described herein is provided with the square carton top 131 such that a carton 13 is provided with enhanced strength for one or more additional cartons 13 or other containers that are vertically stacked thereupon.

Figure 7:
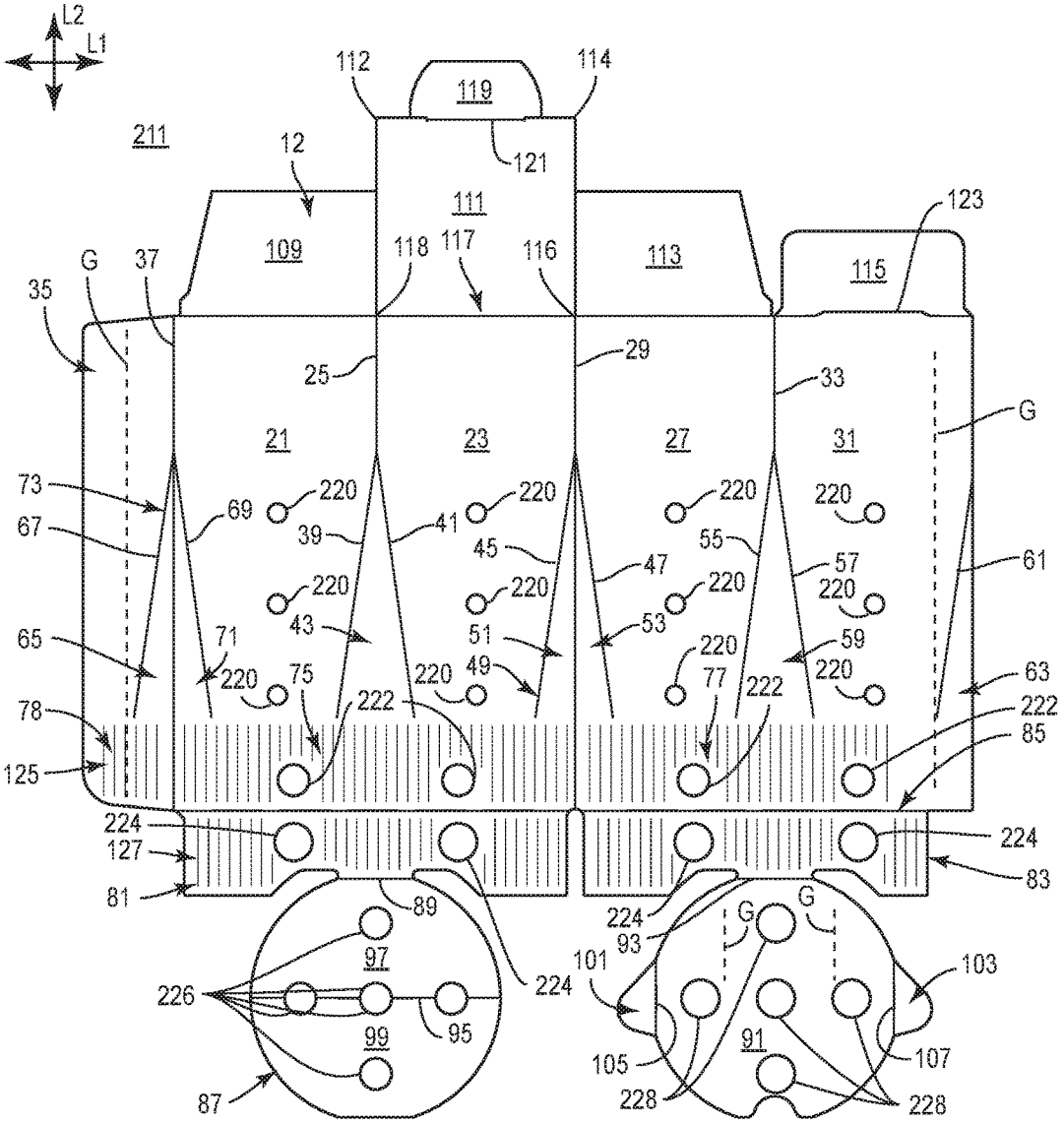
FIG. 7 is a plan view of a blank for forming a carton according to a second exemplary embodiment of the disclosure.

Referring additionally to FIG. 7, a blank 211 for forming a carton 213 is illustrated according to a second exemplary embodiment of the disclosure. The blank 211 and the carton 213 formed therefrom can have one or more features that are substantially similar to those of the blank 11 and the carton 13, and like or similar features are designated with like or similar reference numbers.

As shown, the blank 211 is provided with at least one opening 220 in one or more of the panels 21, 23, 27, 31, one or more openings 222 in one or both of the bottom portions 75, 77, one or more openings 224 in one or both of the bottom reinforcement panels 81, 83, one or more openings 226 in the first bottom end flap 87, and one or more openings 228 in the second bottom end flap 91. It will be understood that the blank 211 can include a different number, arrangement, or configuration of openings without departing from the disclosure.

Figure 8:
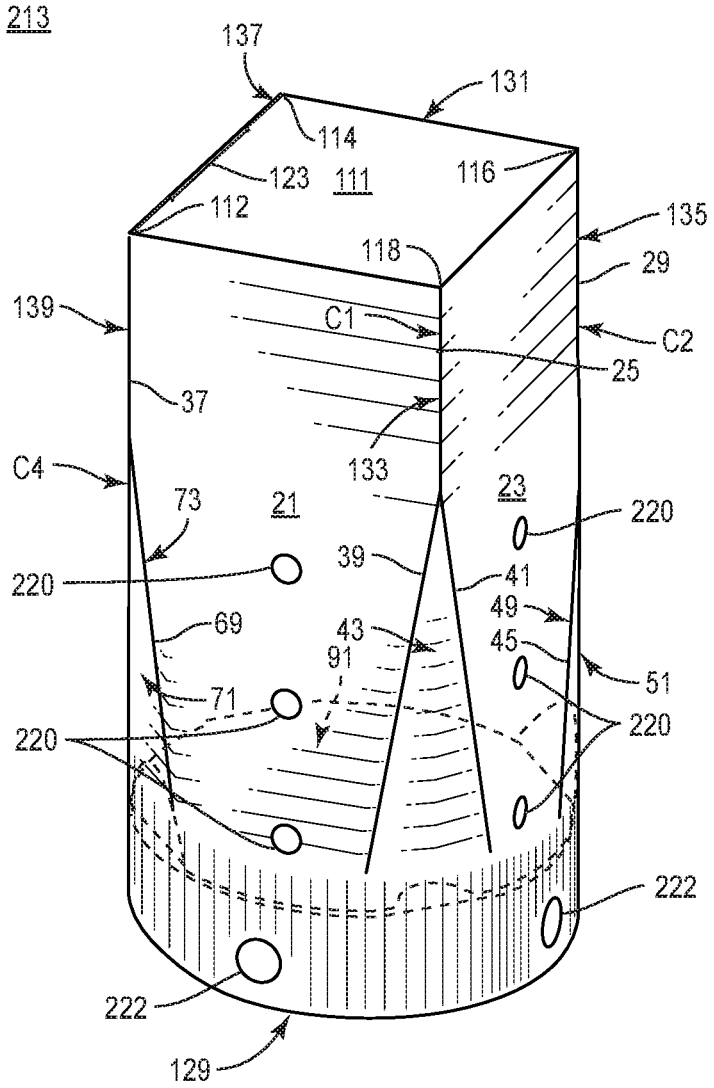
FIG. 8 is a perspective view of a carton formed from the blank of FIG. 7.

Referring additionally to FIG. 8, the carton 213 can be formed from the blank 211, in one embodiment, in the manner described above with respect to the carton 13. The openings 207, 209, 211, 213, 215 can provide, for example, ventilation to one or more articles held in the carton 213. In one embodiment, the openings 207, 209, 211, 213, 215 can provide for visibility of an article held the carton 213. In another embodiment, the openings 207, 209, 211, 213, 215 can provide for drainage or for the escape of evaporated fluids from an article held in the carton 213.

Figure 9:
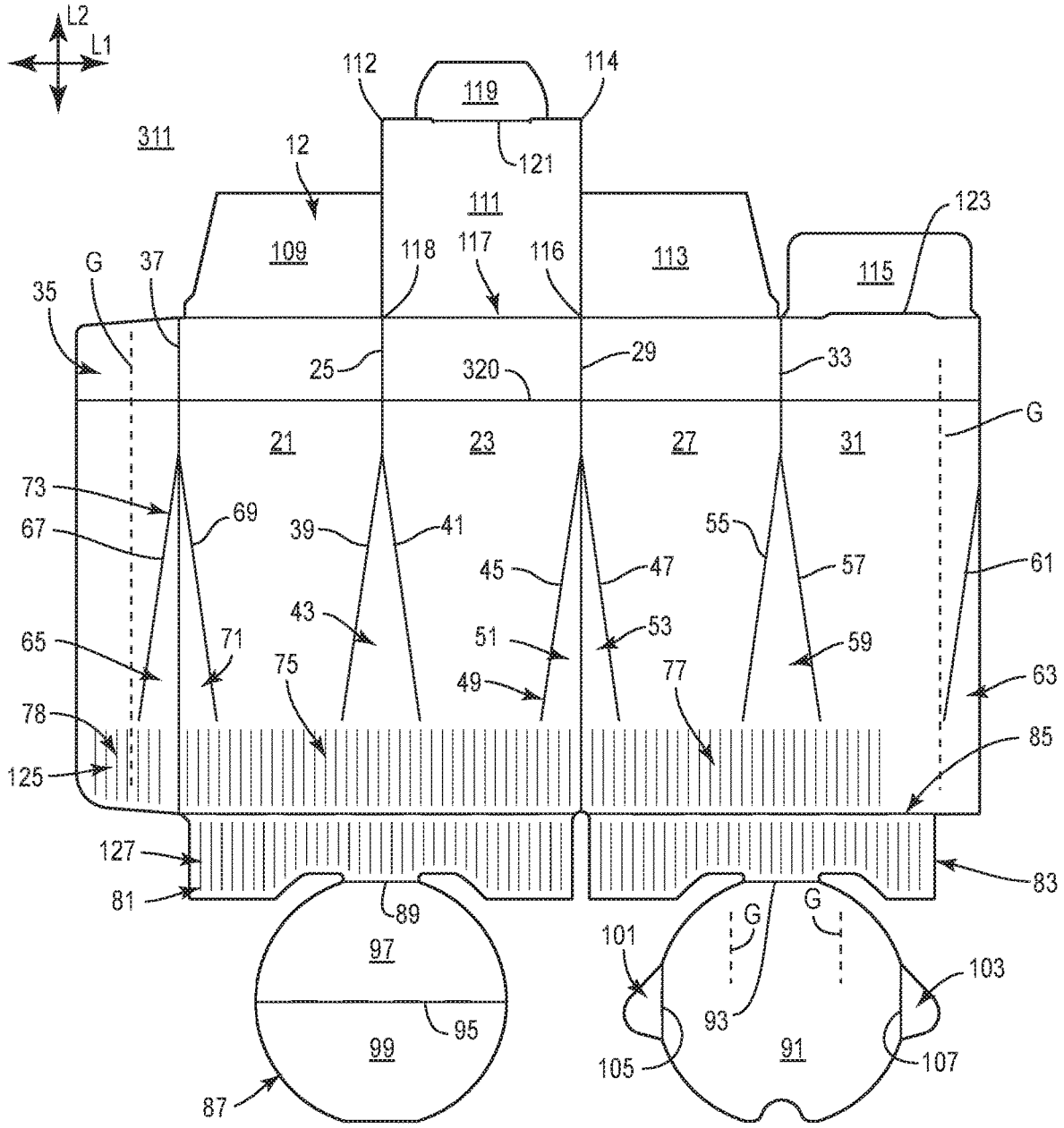
FIG. 9 is a plan view of a blank for forming a carton according to a third exemplary embodiment of the disclosure.

Turning to FIG. 9, a blank 311 for forming a carton 313 is illustrated according to a third exemplary embodiment of the disclosure. The blank 311 and the carton 313 formed therefrom can have one or more features that are substantially similar to those of the blanks 11, 211 and the cartons 13, 213, and like or similar features are designated with like or similar reference numbers.

As shown, the blank 311 is provided with a line of weakening 320, for example a longitudinal tear line or perforated line, extending across respective upper portions of the panels 21, 23, 27, 31 and the attachment flap 35. In this regard, the tear line 320 and the features of the blank 311 above the tear line 320 (e.g., upper portions of the respective panes 21, 23, 27, 31 and the attachment flap 35, the top end flaps 109, 111, 113, 115, and the locking flap 119) are dispenser features for forming a dispenser 322 of the carton 313.

Referring additionally to FIG. 10, the carton 313 can be formed from the blank 311, in one embodiment, in the manner described above with respect to the cartons 13, 213. As shown, the dispenser 322 is at least partially separable from the remainder of the carton 313 at the line of weakening 320, for example, for ease of retrieval of one or more articles disposed in the carton 313 by a customer or for visible display in a retail space. In one embodiment, the line of weakening 320 can be arranged such that the carton top 131 is hingably attached to the remainder of the carton 313.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the cartons, to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels extending at least partially around an interior of the carton, the plurality of panels comprising a front panel, a back panel, and at least one side panel, adjacent panels of the plurality of panels are foldably connected at a respective at least one fold line, the at least one fold line comprises a lateral fold line intersecting a respective pair of oblique fold lines;

a plurality of corners extending from the closed top of the carton to the closed bottom of the carton, each corner has a respective upper corner portion and a respective lower corner portion disposed between respective adjacent panels of the plurality of panels, each lower corner portion is at least partially defined between the respective pair of oblique fold lines;

at least one top end flap foldably connected to a panel of the plurality of panels, the at least one top end flap is for forming a closed top of the carton;

at least one bottom end flap foldably connected to a panel of the plurality of panels, the at least one bottom end flap is for forming a closed bottom of the carton; and the closed top of the carton has a square configuration and the closed bottom has a round configuration.

2. The carton of claim 1, wherein each upper corner portion has an orthogonal configuration and each lower corner portion has a curved configuration.

3. The carton of claim 2, wherein each upper corner portion is defined by the respective adjacent panels and the lateral fold line.

4. The carton of claim 3, wherein at least a portion of each lower corner portion is planar.

5. The carton of claim 3, wherein the at least one side panel is a first side panel and the plurality of panels further comprises a second side panel, the at plurality of corners comprises a first corner between the front panel and the first side panel and formed by a first upper corner portion and a first lower corner portion, the plurality of corners further comprises a second corner between the first side panel and the back panel and formed by a second upper corner portion and a second lower corner portion, plurality of corners further comprises a third corner between the back panel and the second side and formed by a third upper corner portion and a third lower corner portion, and the plurality of corners further comprises a fourth corner between the second side panel and the front panel and formed by a fourth upper corner portion and a fourth lower corner portion.

6. The carton of claim 2, wherein the at least one top end flap has a plurality of orthogonal corners, the at least one corner of the carton comprises a plurality of corners, each upper corner portion of a respective corner of the plurality of corners corresponds to a respective orthogonal corner of the plurality of orthogonal corners of the at least one top end flap.

7. The carton of claim 6, wherein the at least one bottom end flap has a round configuration, the plurality of panels and the plurality of lower corner portions together circumscribe the at least one bottom end flap.

8. The carton of claim 7, wherein the plurality of panels further comprises a bottom reinforcement panel foldably connected to at least two of the front side panel, the back side panel, and the at least one side panel, the bottom reinforcement panel provides a stop edge for engaging the at least one bottom end flap.

9. The carton of claim 7, wherein the at least one bottom end flap comprises a first section foldably connected to a second section.

10. The carton of claim 9, wherein the at least one bottom end flap is a first bottom end flap, and the carton further comprises a second bottom end flap foldably connected to a panel of the plurality of panels and at least one extension flap foldably connected to the second bottom end flap for engaging an interior surface of at least one panel of the plurality of panels.

11. The carton of claim 6, wherein the carton further comprises a dispenser comprising an upper portion of each panel of the plurality of panels and the at least one top end flap.

12. The carton of claim 11, wherein the dispenser is separably connected to the remainder of the carton at a tear line.

13. The carton of claim 6, wherein the at least one bottom end flap comprises at least one opening.

14. The carton of claim 13, wherein at least one panel of the plurality of panels comprises an opening.

15. A blank for forming a carton for holding at least one article, the blank comprising:

a plurality of panels for extending at least partially around an interior of the carton formed from the blank, the plurality of panels comprising a front panel, a back panel, and at least one side panel, adjacent panels of the plurality of panels are foldably connected at a respective at least one fold line, the at least one fold line comprises a lateral fold line intersecting a respective pair of oblique fold lines;

a plurality of corner portions for forming a plurality of corners extending from the closed top of the carton to the closed bottom of the carton formed from the blank, each corner portion has a respective upper corner portion and a respective lower corner portion disposed between respective adjacent panels of the plurality of panels, each lower corner portion is at least partially defined between the respective pair of oblique fold lines;

at least one top end flap foldably connected to a panel of the plurality of panels, the at least one top end flap is for forming a closed top of the carton formed from the blank; and at least one bottom end flap foldably connected to a panel of the plurality of panels, the at least one second end flap is for forming a closed bottom of the carton formed from the blank such that the closed top of the carton formed from the blank has a square configuration and the closed bottom formed from the blank has a round configuration.

16. The blank of claim 15, wherein each upper corner portion for at least partially forming the plurality of corners of the carton formed from the blank is defined by the respective adjacent panels and the lateral fold line.

17. The blank of claim 15, wherein the at least one top end flap has a plurality of orthogonal corners and the at least one bottom end flap has a round configuration.

18. The blank of claim 17, wherein the plurality of panels further comprises a bottom reinforcement panel foldably connected to at least two of the front side panel, the back side panel, and the at least one side panel.

19. The blank of claim 17, wherein the at least one bottom end flap comprises a first section foldably connected to a second section.

20. The blank of claim 19, wherein the at least one bottom end flap is a first bottom end flap, and the carton further comprises a second bottom end flap foldably connected to a panel of the plurality of panels and at least one extension flap foldably connected to the second bottom end flap for engaging an interior surface of at least one panel of the plurality of panels when the carton is formed from the blank.

21. The blank of claim 17, wherein the blank further comprises a dispenser comprising an upper portion of each panel of the plurality of panels and the at least one top end flap, the dispenser is separably connected to the remainder of the blank at a tear line.

22. The blank of claim 17, wherein the at least one bottom end flap comprises at least one opening, and at least one panel of the plurality of panels comprises an opening.

23. A method of forming a carton for holding at least one article, the method comprising:

obtaining a blank comprising a plurality of panels comprising a front panel, a back panel, and at least one side panel, adjacent panels of the plurality of panels are foldably connected at a respective at least one fold line, the at least one fold line comprises a lateral fold line intersecting a respective pair of oblique fold lines, the blank further comprising at least one top end flap foldably connected to a panel of the plurality of panels, and at least one bottom end flap foldably connected to a panel of the plurality of panels, the blank further comprising a plurality of corner portions, each corner portion has a respective upper corner portion and a respective lower corner portion disposed between respective adjacent panels of the plurality of panels, each lower corner portion is at least partially defined between the respective pair of oblique fold lines;

folding the plurality of panels at least partially around an interior of the carton and such that the plurality of corner portions form a plurality of corners; and folding the at least one top end flap to form a closed top of the carton and folding the at least one bottom end flap to form a closed bottom of the carton such that the closed top of the carton has a square configuration and the closed bottom has a round configuration, each corner of the plurality of corners extends from the closed top of the carton to the closed bottom of the carton.

24. The method of claim 23, wherein each upper corner portion has an orthogonal configuration and each lower corner portion has a curved configuration.

25. The method of claim 24, wherein each upper corner portion is defined by the respective adjacent panels and the lateral fold line, and each lower corner portion is at least partially defined between the pair of oblique fold lines.

26. The method of claim 25, wherein at least a portion of each lower corner portion is planar.

27. The method of claim 25, wherein the at least one side panel is a first side panel and the plurality of panels further comprises a second side panel, the plurality of corners comprises a first corner between the front panel and the first side panel and formed by a first upper corner portion and a first lower corner portion, the plurality of corners further comprises a second corner between the first side panel and the back panel and formed by a second upper corner portion and a second lower corner portion, the plurality of corners further comprises a third corner between the back panel and the second side and formed by a third upper corner portion and a third lower corner portion, and the plurality of corners further comprises a fourth corner between the second side panel and the front panel and formed by a fourth upper corner portion and a fourth lower corner portion.

28. The method of claim 24, wherein the at least one top end flap has a plurality of orthogonal corners, each upper corner portion of a respective corner of the plurality of corners corresponds to a respective orthogonal corner of the plurality of orthogonal corners of the at least one top end flap.

29. The method of claim 28, wherein the at least one bottom end flap has a round configuration, the plurality of panels and the plurality of lower corner portions together circumscribe the at least one bottom end flap.

30. The method of claim 29, wherein the plurality of panels further comprises a bottom reinforcement panel foldably connected to at least two of the front side panel, the back side panel, and the at least one side panel, the bottom reinforcement panel provides a stop edge for engaging the at least one bottom end flap.

31. The method of claim 29, wherein the at least one bottom end flap is a first bottom end flap comprising a first section foldably connected to a second section, and the carton further comprises a second bottom end flap foldably connected to a panel of the plurality of panels and at least one extension flap foldably connected to the second bottom end flap for engaging an interior surface of at least one panel of the plurality of panels.

32. The method of claim 28, wherein the carton further comprises a dispenser comprising an upper portion of each panel of the plurality of panels and the at least one top end flap, the dispenser is separably connected to the remainder of the carton at a tear line.

33. The method of claim 28, wherein the at least one bottom end flap comprises at least one opening, and at least one panel of the plurality of panels comprises an opening.

* * * * *